US006164209A

United States Patent [19]

Best et al.

[11] Patent Number: 6,164,209

[45] Date of Patent: Dec. 26, 2000

[54] SHOTSHELL BASEWAD

[75] Inventors: Gregory C. Best, Staunton, Ill.; Scott H. Mayfield, St. Louis, Mo.; Brian B. Belknap, Pembroke Pines, Fla.; Morris C. Buenenmann, Jr., Florissant, Mo.; Robert J. Gardner, Bethalto; Alan J. Corzine, Brownstown, both of Ill.

[73] Assignee: Olin Corporation, East Alton, Ill.

[21] Appl. No.: 09/255,600

[22] Filed: Feb. 22, 1999

Related U.S. Application Data

[60] Provisional application No. 60/113,234, Dec. 21, 1998.

[51] Int. Cl.[7] ..... F42B 7/06; F42B 7/08

[52] U.S. Cl. ..... 102/450; 102/439; 102/466; 102/502; 102/532

[58] Field of Search ..... 102/430, 439, 102/444, 447–467, 469, 470, 502, 513, 532

[56] References Cited

U.S. PATENT DOCUMENTS

| | | | |
|---|---|---|---|
| 408,246 | 8/1889 | Lindsey . | |
| 957,171 | 5/1910 | Loeb . | |
| 2,849,954 | 9/1958 | Robinson et al. | 102/42 |
| 2,936,709 | 5/1960 | Seavey | 102/44 |
| 3,191,534 | 6/1965 | Vecchiotti | 102/95 |
| 3,229,634 | 1/1966 | Moehlman et al. | 102/42 |
| 3,298,313 | 1/1967 | Comerford | 102/95 |
| 3,332,352 | 7/1967 | Olson et al. | 102/467 |
| 3,351,014 | 11/1967 | Metcalf et al. | 102/43 |
| 3,359,906 | 12/1967 | Herter | 102/95 |
| 3,550,531 | 12/1970 | Carter | 102/42 |
| 3,590,740 | 7/1971 | Herter | 102/44 |
| 3,614,929 | 10/1971 | Herter et al. | 102/466 |

(List continued on next page.)

FOREIGN PATENT DOCUMENTS

| | | | |
|---|---|---|---|
| 405035 | 7/1970 | Australia | 102/450 |
| 2013981 | 6/1991 | Canada | 102/467 |
| 103509 | 3/1984 | European Pat. Off. | 102/502 |
| 947711 | 7/1949 | France | 102/448 |
| 651780 | 1/1963 | Italy | 102/469 |

OTHER PUBLICATIONS

Carton side panel Winchester AA Shotshell, Olin Corporation, 1995.

Winchester Ammunition Product Guide, Olin Corporation, 1995, p. 3.

Winchester 1986 Ammunition Guide, Olin Corporation, 1986, p. 5.

Winchester Ammunition 1998 Product Guide, Olin Corporation, 1998, p. 6.

Advertisement, "the Gordon system" shotshells, Baschieri & Pellagri, 1996.

Winchester Ammunition Reloader's Manual, 15$^{th}$ Edition, Olin Corporation, 1997, pp. 16–17.

Winchester Reloading Components Catalog, 9$^{th}$ Edition, Olin Corporation, 1985, p. 11.

*Primary Examiner*—Harold J. Tudor

*Attorney, Agent, or Firm*—Wiggin & Dana; William B. Slate

[57] ABSTRACT

An ammunition cartridge has a tube extending along a central longitudinal axis from an aft end to a fore end. The tube has an interior surface and an exterior surface. A metallic head has a sleeve portion secured to the tube along an aft section of the tube and has a centrally-apertured web portion spanning the sleeve portion so as to form a base of the cartridge. A basewad is contained within the tube and is separately formed therefrom. The basewad is located proximate the aft end of the tube. The basewad has a generally cylindrical exterior surface engaging the interior surface of the tube, an aft surface contacting the metal head, an interior surface. The interior surface extends from a generally forward-facing inner portion, forward and outward to a generally inward-facing fore portion so as to define a skirt portion of the basewad between the exterior surface and interior surface. At least one projectile is carried within a fore volume of the tube. A propellant charge is located aft of the projectile. Wadding is located between the propellant charge and the projectile. The wadding includes an aft portion located at least partially concentrically within the skirt portion of the basewad so as to define a powder chamber containing the propellant charge.

26 Claims, 3 Drawing Sheets

U.S. PATENT DOCUMENTS

| | | | |
|---|---|---|---|
| 3,710,720 | 1/1973 | Mawhinney | 104/42 |
| 3,835,783 | 9/1974 | Curran | 104/42 |
| 3,906,859 | 9/1975 | Smith | 102/444 |
| 3,974,775 | 8/1976 | Kerzman et al. | 102/95 |
| 4,007,686 | 2/1977 | Hugonet | 102/467 |
| 4,867,066 | 9/1989 | Buenemann, Jr. | 102/470 |
| 4,947,752 | 8/1990 | Richert | 102/430 |
| 4,970,959 | 11/1990 | Bilsbury et al. | 102/450 |
| 5,035,183 | 7/1991 | Luxton | 102/502 |
| 5,127,331 | 7/1992 | Stoops | 102/467 |
| 5,315,932 | 5/1994 | Bertram | 102/457 |
| 5,408,931 | 4/1995 | Tallman | 102/439 |
| 5,691,501 | 11/1997 | Gilbert | 102/444 |
| 5,710,391 | 1/1998 | Chetcuti | 102/430 |

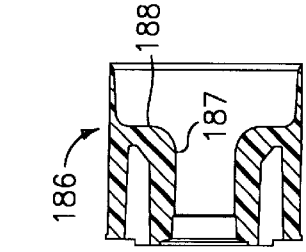
FIG. 11
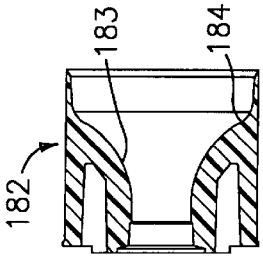
FIG. 10
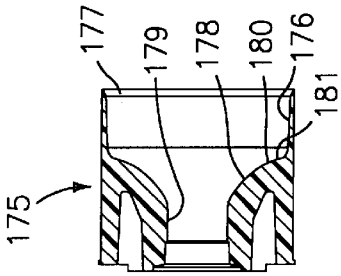
FIG. 9
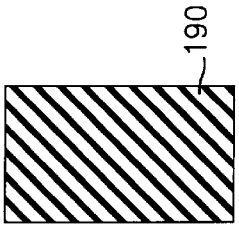
FIG. 12
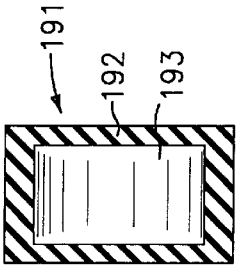
FIG. 13
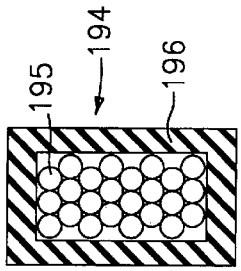
FIG. 14
FIG. 15
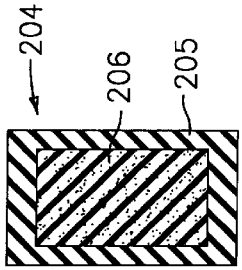
FIG. 16
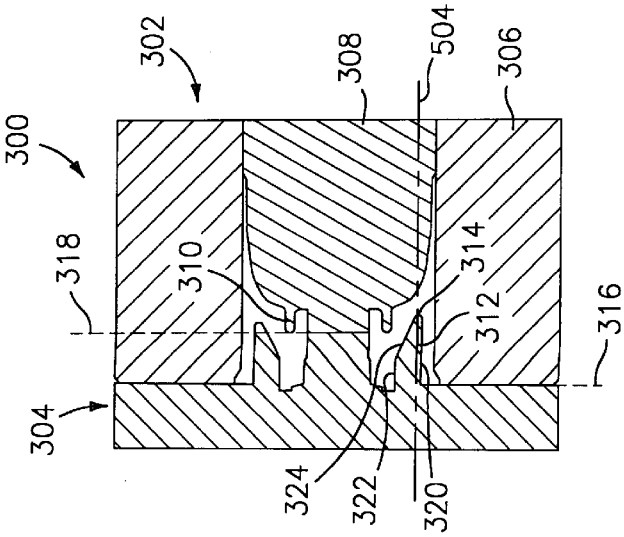
FIG. 8

SHOTSHELL BASEWAD

This application claims the benefit of prior U.S. provisional application Ser. No. 60/113,234 filed on Dec. 21, 1998.

BACKGROUND OF THE INVENTION

1. Field of the Invention

The invention relates to shotshells. More particularly, the invention relates to shotshell basewad constructions.

2. Description of Related Art

A typical shotshell 20 (FIG. 1) has a hull which is generally analogous to the case of a small arms ammunition round. An example of such a shotshell 20 is the WINCHESTER XPERT shotshell by Olin Corporation, East Alton, Ill. The hull includes a tube 24, a basewad 26, and a metal head 28. The tube and basewad are usually separately formed but, not infrequently, may be unitarily formed. The tube is typically formed of plastic and may be of a type known the Reifenhauser tube. At the aft end 30 of the shotshell, the basewad is inserted in a tight fitting relation into the aft end of the tube. The cup-shaped metal head 28 surrounds an aft portion of the tube and is crimped to the outwardly-flared aft end of the tube and basewad to mechanically secure the three together and forms an annular rim 32 which is useful to assist in extraction of the hull from a shotgun (not shown) once fired. A central aperture 34 in the metal head 28 and co-aligned pocket 36 in the basewad accommodate a battery cup-type primer 38 in press fit relation. A propellant charge 40 is located in a powder chamber within the hull at least partially defined by a forward surface 42 of the basewad. An aft surface 43 of an over-powder wad illustrated as an over-powder cup 44 typically bounds most of the remainder of the powder chamber. The aft rim 45 of the over-powder cup may be close to contacting a forward rim 46 of the basewad. Thus, between the aft rim 45 and the forward rim 46, the powder chamber may be bounded by a cylindrical segment of the interior surface 47 of the tube 24.

A number of problems have plagued existing shotshells. Among these problems are the inadequate sealing of combustion gases against infiltration between the basewad and tube and against infiltration between the basewad and primer. A number of solutions have been proposed for such sealing problems. U.S. Pat. No. 3,359,906, of George L. Herter, shows a basewad with longitudinal arrays of angled annular sealing rings or teeth both on the outboard surface of the basewad and on the primer pocket surface of the basewad. Such teeth are respectively asserted as providing enhanced sealing against infiltration between the basewad and tube and between the basewad and primer.

U.S. Pat. No. 4,867,066 of Morris C. Buenemann, Jr., discloses the use of a ruptured disk-shaped injection molding gate on an interior primer hub surface. The gate provides an annular gas seal between the primer and the basewad.

The adoption of a one-piece compression-formed replacement for the separate basewad and tube eliminates the issue of infiltration between the basewad and tube. An early such one-piece configuration is shown in U.S. Pat. No. 3,351,014 of John S. Metcalf et al. A more recent example of a one-piece configuration is the WINCHESTER DOUBLE A line of shotshells by Olin Corporation. The DOUBLE A shotshell may include a one-piece wad visually similar to the wad of the shotshell 20 which may have an over-powder cup slightly smaller in diameter and slightly more compliant to engage the tapering inside surface of the compression-formed hull. Additionally, during the heading process (fitting of the metal head to the compression-formed plastic element) as the head is pressed forward and flattened onto the plastic hull element, a corresponding rearward pressure on an annular fixture inserted into the hull produces a channel in the basewad surrounding the primer pocket. Deformation of the plastic hull element via the impression of the channel provides for enhanced sealing with the primer.

Some users may still prefer hulls having separate basewads and tubes. Accordingly, there remains a need for improved two-piece combinations of a tube and basewad.

BRIEF SUMMARY OF THE INVENTION

The inventors have sought to provide a basewad offering enhanced performance. The inventors have observed a number of areas in which performance of existing shotshells may be improved. In one broad area, the inventors have observed the effects of combustion gases generated by the burning propellant charge. The inventors have observed the results of the apparent infiltration or leakage of such gases: a) between the basewad and tube; and b) between the basewad and battery cup. Such leakage may cause a bulging of the head which may interfere with ejection/extraction of the spent hull from the shotgun. Additionally, once such leakage occurs, it is no longer possible or appropriate to reload the hull.

The inventors have also observed that, during handling, smaller particles of the propellant charge may sift between the over-powder cup and tube, potentially affecting performance when the shotshell is fired.

Another area of performance the inventors have observed relates to the speed and completeness of propellant combustion. The inventors have observed inconsistent performance between apparently identically-prepared shotshells. Often, inconsistent performance is associated with variation in the amount and character of muzzle flash. Muzzle flash is caused by the continuing combustion of propellant as it exits the muzzle of the shotgun. Advantageously, efficient use of the propellant is associated with reduced muzzle flash as earlier combustion of the propellant (i.e. as the shotwad is closer to its origin within the hull rather than downstream in the barrel or beyond the muzzle) indicates a higher amount of the combustion energy is transferred to the projectile as kinetic energy.

The inventors have also observed parameters of the manufacturing of the basewads. Particularly, the inventors have observed the results of cooling of molded plastic basewads. As the plastic material gradually cools, it contracts, thereby inducing deformations in the molded basewad. One observed deformation is the radial shrinkage upon cooling, in particular shrinkage characterized by the forming of a waist in the basewad. Such shrinkage may also be associated with reduced sealing and increased gas infiltration between the head and tube.

Accordingly, in one aspect, the invention is directed to an ammunition cartridge having a tube extending along a central longitudinal axis from an aft end to a fore end. The tube has an interior surface and an exterior surface. A metallic head has a sleeve portion secured to the tube along an aft section of the tube and has a centrally-apertured web portion spanning the sleeve portion so as to form a base of the cartridge. A basewad is contained within the tube and is separately formed therefrom. The basewad is located proximate the aft end of the tube. The basewad has a generally cylindrical exterior surface engaging the interior surface of the tube, an aft surface contacting the metal head, an interior surface. The interior surface extends from a generally forward-facing inner portion, forward and outward to a generally inward-facing fore portion so as to define a skirt portion of the basewad between the exterior surface and interior surface. At least one projectile is carried within a fore volume of the tube. A propellant charge is located aft of the projectile. Wadding is located between the propellant charge and the projectile. The wadding includes an aft portion located at least partially concentrically within the skirt portion of the basewad so as to define a powder chamber containing the propellant charge.

In various implementations, the aft portion may be an aft-facing powder cup and the wadding may further comprise a forward facing shot cup and a compressible midsection connecting the shot cup to the powder cup. The projectile may consist essentially of a single slug or of a plurality of shot pellets. The basewad may have an annular bevel surface coupling the fore portion of the basewad interior surface to the basewad exterior surface. The bevel surface may have a first cone angle between the bevel surface and the central longitudinal axis greater than a second cone angle between the fore portion of the basewad interior surface and the central longitudinal axis. The tube interior surface may have a diameter along a substantial portion of a tube length of about 0.7 inch (1.8 cm) to about 0.8 inch (2.0 cm) and the basewad may have an overall length of at least about 0.8 inch (2.0 cm). The propellant charge may have a mass of about 5 grains (0.32 gm) or less.

In another aspect, the invention is directed to a unitary plastic basewad having an aft-facing, central-apertured, base surface. An internal primer pocket surface extends forward from the central aperture of the base surface. An external, generally cylindrical, tube-engaging surface extends forward from the base surface to a wad mouth. An internal powder cup-engaging surface encircles and slidably engages a powder cup.

Implementations of the invention may include the basewad having an internal, generally fore-to-aft tapering surface coupling the powder cup-engaging surface to a hub portion of the basewad. The tapering surface may include an annular, generally forward facing, channel surrounding the hub. The channel may have a depth below a forward rim of the hub and a median width less than half the depth. The depth may be at least 0.06 inch (0.15 cm) and the median width may be less than 0.05 inch (0.13 cm). A plurality of blind compartments may be open to the aft surface and extend forward therefrom. The compartments may have forward extremities located forward of a bottom of the channel. The basewad may include an annular continuous sleeve bounded in part by the tube-engaging surface and the powder cup-engaging surface. The sleeve may extend aft from a rim and have a wall thickness of no more than 0.02 inch (0.051 cm) along at least a forwardmost region of 0.10 inch (0.25 cm) in length, an advantageous range being from about 0.1 inch (0.25 cm) to about 0.4 inch (1.0 cm). Such forwardmost region may be at least 0.20 inch (0.51 cm) in length. The powder cup-engaging surface may have, over a majority of its length, a fore-to-aft taper of less than two degrees. The basewad may have a first surface portion extending generally forward and outward from the primer pocket surface having a first cone angle of less than fifty degrees and a second surface portion extending between the first surface portion and the powder cup-engaging surface having a second cone angle greater than the first cone angle.

Among the advantages of the invention is improved encapsulation of the propellant charge prior to firing of the shotshell. Additionally, upon firing, it may provide an improved resistance to infiltration of combustion gases between the basewad and tube.

In another aspect, the invention is directed to the formation of a basewad having a number of blind compartments open to the aft surface of the basewad and extending forward therefrom. In various implementations, the basewad may be formed of polyethylene and may have a ratio of overall length to exterior surface diameter of from about 1:1 to about 1.2:1. There may advantageously be six to ten such compartments and the aft surface may include a central portion and an outer portion extending radially outward from the central portion and forwardly offset therefrom. The compartments may be located along a boundary between the central portion and the outer portion.

The existence of such compartments in a molded plastic basewad has a number of advantages. First, a reduction in the amount of plastic material used in the basewad is realized. Advantageously, the presence of the compartments can reduce the mass of the basewad by at least 5%, by weight, with 5%–10% being a preferred range for a 12-gauge basewad. Additionally, during manufacture the cooling time that the basewad spends in the associated mold after injection of the liquid plastic material is reduced. This leads to reduced cycle time for the molding equipment and, therefore, improved efficiency. By no means finally, the tendency of the basewad to contract and form a waist upon cooling is reduced.

In another aspect, the invention is directed to an ammunition cartridge which advantageously carries an essentially "non-lethal" projectile or projectiles. The cartridge has a tube extending along a central longitudinal axis from an aft end to a fore end and having interior and exterior surfaces. A metallic head has a sleeve secured to the tube along an aft section of the tube and a centrally-apertured web spanning the sleeve and forming a base of the cartridge. A basewad is carried within the tube and separately formed therefrom. The basewad is located proximate the aft end of the tube and has a generally cylindrical exterior surface engaging the interior surface of the tube. An aft surface of the basewad contacts the metallic head. An interior surface of the basewad extends from a central hub portion forward and outward to define a forward-facing powder chamber. At least one projectile is carried within a fore volume of the cartridge. A propellant charge is located within the powder chamber aft of the projectile. A primer is carried within a primer pocket extending forward from the central aperture of the head and into the basewad. Wadding is positioned between the propellant charge and the projectile. The propellant charge is sized so that when the cartridge is chambered and the weapon having a barrel length in the range of 14–24 inches (36–61 cm), and the primer is caused to ignite the propellant charge, the projectile is expelled from the weapon with a muzzle velocity of no more than about 1,000 feet per second (fps) (305 m/s) but typically greater than 200 fps (61 m/s). In various implementations, the muzzle velocity may be no more than about 550 fps (168 m/s) but advantageously more than about 350 fps (107 m/s) when the projectile is expelled from a weapon having a barrel length in the range of 18–22 inches (46–56 cm). The projectile may be a single projectile having a mass of about 1 ounce (28 gm) or less. The propellant charge may have a mass of less than five grains (0.32 gm). Suitable non-lethal projectiles include elastomers (including single slugs or multiple shot), liquid-filled projectiles, foam-filled projectiles, sponge/solid foam-tipped projectiles, or batons, or may have a plurality of solid particles encased in a flexible cover.

Among the advantages of the invention are consistency of propellant ignition with a relatively small propellant charge and low muzzle velocity. Such consistency is advantageous if the projectile is to be fired at an individual with velocity effective to provide a desired stopping, incapacitating, deterring or like result while not inducing permanent or major injury.

These and other aspects of the present invention will be readily apparent upon reading the following detailed description of the invention, as well as the drawing and the claims.

BRIEF DESCRIPTION OF THE DRAWINGS

FIG. 8 is a longitudinal sectional view of a mold for molding the basewad of FIG. 3.

FIG. 9 is a longitudinal sectional view of a first alternate basewad according to principles of the invention.

FIG. 10 is a longitudinal sectional view of a second alternate basewad according to principles of the invention.

FIG. 11 is a longitudinal sectional view of a third alternate basewad according to principles of the invention.

FIG. 12 is a longitudinal cross-sectional view of a first non-lethal projectile for use with the basewad of FIG. 9.

FIG. 13 is a longitudinal cross-sectional view of a second non-lethal projectile for use with the basewad of FIG. 9.

FIG. 14 is a longitudinal cross-sectional view of a third non-lethal projectile for use with the basewad of FIG. 9.

FIG. 15 is a longitudinal cross-sectional view of a fourth non-lethal projectile for use with the basewad of FIG. 9.

FIG. 16 is a longitudinal cross-sectional view of a fifth non-lethal projectile for use with the basewad of FIG. 9.

Like reference numbers and designations in the several views indicate like elements.

DETAILED DESCRIPTION OF THE INVENTION

Figure 1:
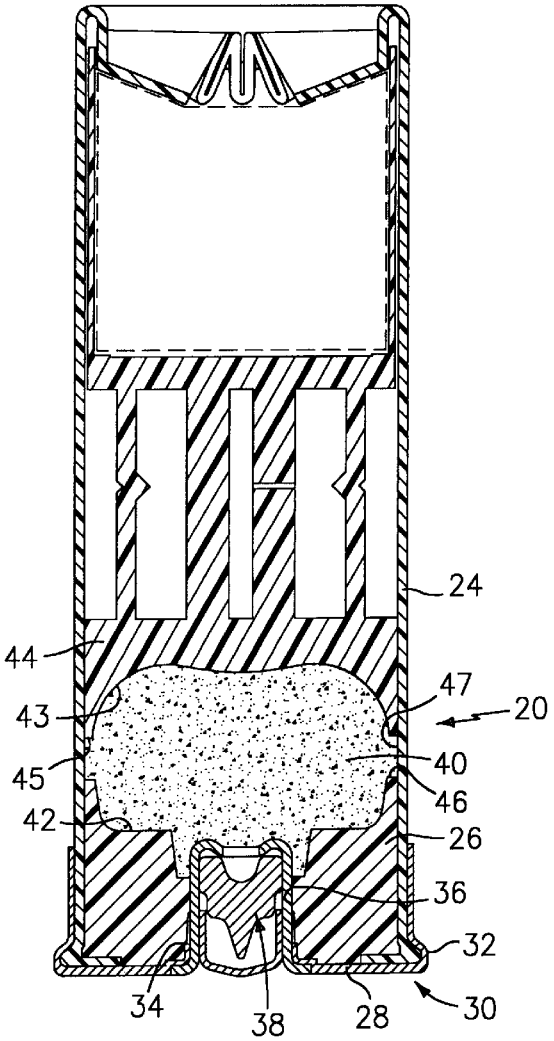
FIG. 1 (PRIOR ART)
FIG. 1 is a longitudinal sectional view of a prior art shotshell.
Figure 2:
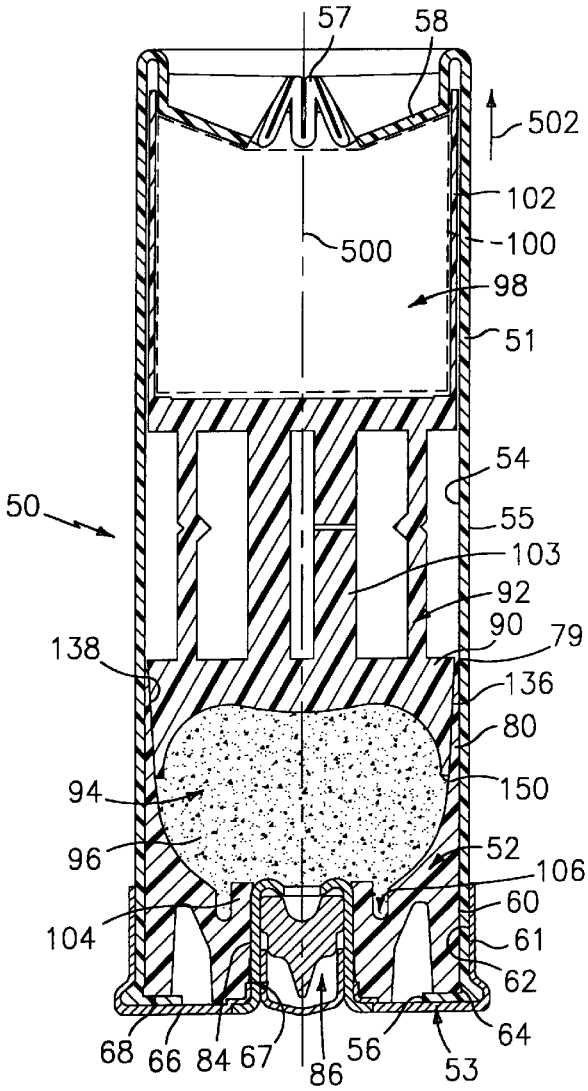
FIG. 2 is a longitudinal sectional view of a shotshell according to principles of the present invention.

FIG. 2 shows a shotshell 50 according to principles of the invention. The shotshell 50 has a central longitudinal axis 500. A forward direction 502 is defined parallel to the central longitudinal axis with a rearward direction being opposite thereof. By way of example, the shotshell of FIG. 2 has proportions generally corresponding to an embodiment as a 12-gauge shotshell.

The shotshell 50 has a hull including a tube 51, a basewad 52, and a metallic head 53. The tube 51 is of conventional construction and may be formed of paper or plastic (e.g., polyethylene). The head 53 may similarly be of conventional construction and may be formed of steel or brass.

The tube 51 has interior and exterior predominately cylindrical surfaces 54 and 55 respectively. The tube 51 extends from an aft end 56 to a fore end 57. A foremost portion 58 of the tube forms a crimp enclosing a fore end of the shotshell.

Proximate the aft end 56 of the tube 51, the basewad 52 is contained within the tube. A lateral, longitudinally-extending, generally cylindrical, exterior surface 60 of the basewad engages the interior surface 54 of the tube in direct contact along a length thereof.

The head 53 is unitarily formed having a sleeve portion 61, an interior surface 62 of which contacts the exterior surface 55 of the tube. At its aft end, the sleeve flares outward to form a rim of the shotshell which compressively holds on outwardly flared aft portion of the tube to a beveled shoulder or lip 64 of the basewad. A web portion 66 of the head spans the sleeve at the aft end thereof, extending inward from the rim to form a base of the cartridge. The web 66 has a central aperture 67 proximate which the web is deformed forwardly. The web contacts an aft or base surface 68 of the basewad.

The basewad exterior surface 60 is of a diameter effective to maintain itself in engagement with the interior surface 54 of the tube 51. In the exemplary 12-gauge shotshell embodiment, the exterior surface 60 has a diameter of about 0.74 inches (0.19 cm). As shown in further detail in FIG. 3, the basewad 52 additionally includes an interior surface 72 extending from a generally forward facing inner portion 74 forward and outward to a generally inward facing fore portion 76. An annular frustoconical bevel surface 78 meets the exterior surface 60 at an annular vertex 79 defining a rim at the forward extremity of the basewad. The bevel surface 78 thus connects the fore portion 76 to the exterior surface 60. The interior surface 76, exterior surface 60 and bevel surface 78 bound a skirt or sleeve portion 80 of the basewad. Extending forward from a central aperture in the aft surface 68 is a primer pocket 82 formed by a stepped primer pocket surface 84. When the hull is assembled as shown in FIG. 2, a primer, such as a battery cup-type primer 86, extends through the central aperture 67 of the head 53 and into the primer pocket where the primer 86 is firmly engaged by the primer pocket surface 84.

As further shown in FIG. 2, telescoped within a fore portion of the skirt 80 is an aft-facing over-powder cup portion ("powder cup") 90 of wadding 92. The powder cup 90 and basewad 52 cooperate to define a powder chamber 94 containing a propellant charge 96. A fore volume 98 of the shotshell contains one or more projectiles 100 carried by an over-shot cup portion ("shot cup") 102 of the wadding 92. In a preferred embodiment, the wadding 92 is a WINCHESTER DOUBLE A one-piece shotwad as used in WINCHESTER DOUBLE A shotshells having compression-formed shotshell hulls. Other wadding configurations (e.g. a combination of a paper or plastic over-powder cup, one or more intermediate molded fiber wads, and a shot sleeve or the like surrounding the shotload) may alternatively be used.

Returning to FIG. 3, there can be seen further details of the construction of the basewad 52. Surrounding a fore end of the primer pocket 82, the basewad 52 includes a hub 104 bounded internally by the primer pocket surface 84 and externally by the inboard wall of an annular, generally forward-facing, channel 106. The channel has a bottom 108 located aft of the forward surface or rim 110 of the hub by a channel depth D.

Figure 4:
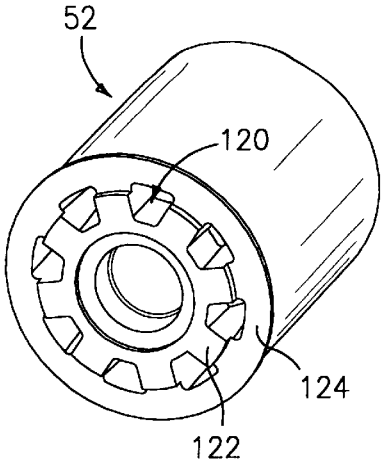
FIG. 4 is a rear perspective view of the basewad of FIG. 3.
Figure 3:
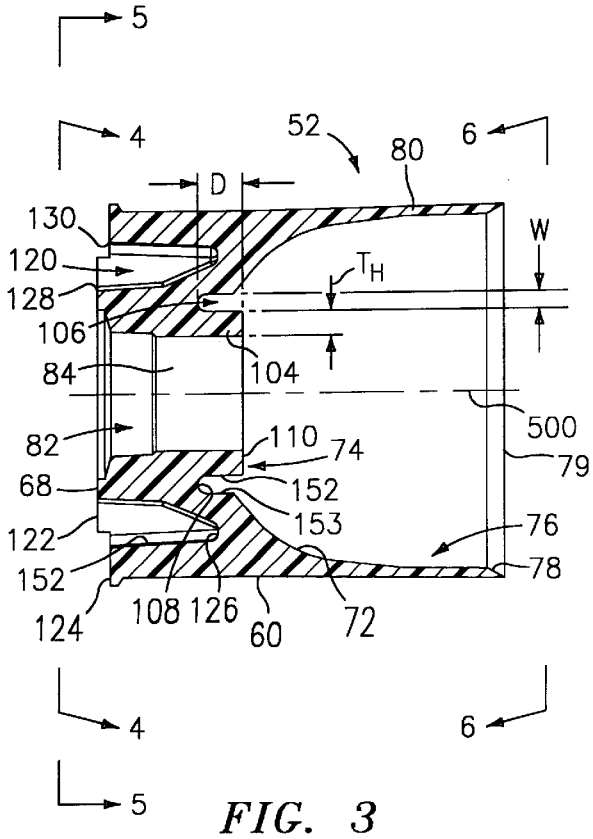
FIG. 3 is a longitudinal sectional view of the basewad of the shotshell FIG. 2.

As shown in FIG. 3 and in further detail in the perspective view of FIG. 4, the basewad has a plurality (e.g., eight in the illustrated embodiment) of blind compartments 120. The compartments 120 are open to the aft surface 68 and extend forward therefrom. The compartments 120 are located on the boundary between a rearwardly projecting central portion 122 of the aft surface 68 surrounding an opening to the primer pocket and an outer portion 124 of the aft surface extending radially outward from the central portion 122 and forwardly offset therefrom.

In the illustrated embodiment of FIG. 3, the compartments 120 do not reach the basewad exterior cylindrical surface 60. Optionally, the compartments may be formed entirely or partially as channels open to the basewad exterior surface 60. The compartments 120 have a compartment length extending longitudinally from the aft surface 68 at its central portion 122 to a forward terminus or extremity 126. An exemplary compartment length is about 0.24 inch (0.6 cm). A maximum radial span of each compartment 120 extends from its inboard extremity 128 to its outboard extremity 130. In the exemplary embodiment, such maximum radial span is about 0.10 inch (0.25 cm). Such maximum radial span may be in a preferred range of about 0.05 inch (0.13 cm) to about 0.2 inch (0.5 cm). The circumferential extent of the compartments 120, measured between approximately radially extending compartment sides 132A and 132B (FIG. 5) will depend on the number of compartments 120 and the thickness of the spokes or webs 134 between adjacent compartments. An exemplary web thickness for the eight-compartment 12 gauge basewad is about 0.07 inch (0.2 cm) at the aft surface 68.

Figure 6:
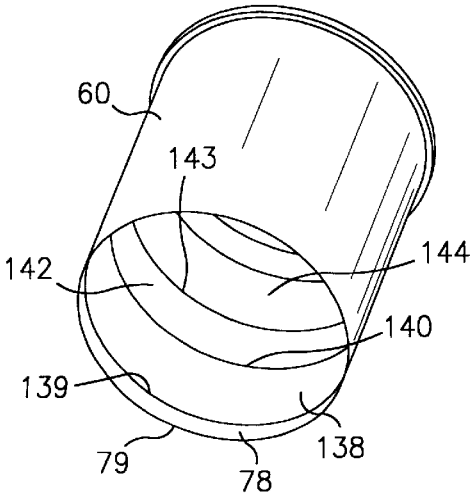
FIG. 6 is a front perspective view of the basewad of FIG. 3.

Returning to FIG. 2, there can be seen details of the skirt portion 80 of the basewad and its interaction with the over-powder cup 90. A nearly cylindrical exterior surface 136 of the over-powder cup 90 is in substantially continuous circumferential contact with a first interior surface portion 138 of the fore portion 76 of the basewad interior surface 72. Details of the first surface portion 138 can be seen in FIGS. 6 and 7. The first surface portion 138 extends aft from an annular junction 139 with the bevel surface 78. The first surface portion 138 extends aft to a second annular junction 140 with a second surface portion 142. The first surface portion 138 is substantially frustoconical with a fore-to-aft taper β (FIG. 7) measured as an overall forward facing cone angle between the surface and the longitudinal direction (e.g. axis 500). Advantageously, β is quite small, preferably less than three degrees, more preferably about two degrees or less, and minimum values for β may be minimum values effective to provide releaseability from a mold. This narrow range of the angle β is advantageous to allow proper telescoping of the over-powder cup within the basewad, while other angles are less sensitive. For example, the bevel surface 78 has a fore-to-aft taper angle θ of about thirty degrees in the exemplary embodiment. This angle is sufficiently small to guide insertion of the over-powder cup 90 into the basewad when the shotshell is loaded. The angle θ (and associated therewith, the wall thickness of the skirt 80 near the rim 79) is, however, large enough so that the skirt 80 is sufficiently robust to withstand loading, discharge, and, preferably, reloading. A broader exemplary range for θ is from about 20° to about 45°. Specifically, at the junction 139, the skirt 80 has a wall thickness t. In the exemplary embodiment, the thickness t is about 0.015 inches (0.0038 cm). Given the shallow angle β, the wall thickness does not greatly increase along the first portion 138 extending to the second junction 140 at a distance $L_1$ from the rim 79. For example, with an exemplary distance $L_1$ of 0.20 inches (0.5 cm) and an angle β of one degree, the wall thickness increases only to about 0.018 inches (0.0046 cm) at the second junction 140 from the wall thickness t of 0.015 inches (0.0038 cm) at the first junction 139.

Figure 7:
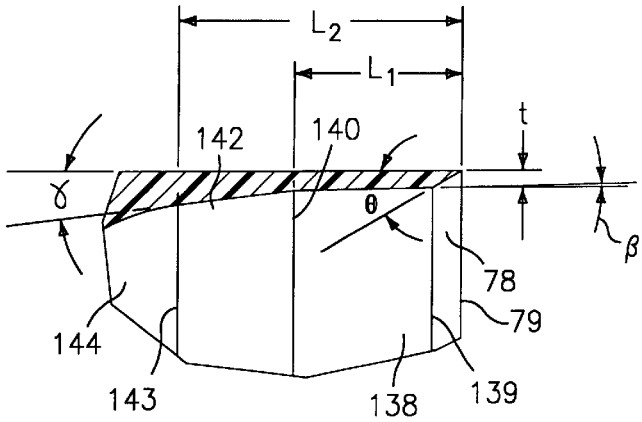
FIG. 7 is a partial cross-sectional view of a fore end of the basewad of FIG. 3.

Proceeding aft from the second junction 140, the fore-to-aft taper further increases. In the exemplary embodiment, the second surface portion 142 has a taper angle γ (FIG. 7). As discussed in further detail below, the angle aft of the powder cup-engaging portion of the basewad may vary significantly based upon the application for which the basewad is designed. An exemplary angle γ for a basewad defining a relatively voluminous powder chamber is about seven degrees as shown in the embodiment of FIG. 7. In the illustrated embodiment, the second surface portion 142 extends aft from the second junction 140 to a third junction 143 with a curving portion 144 of the interior surface along which the taper further increases.

As shown in FIG. 2, prior to firing of the shotshell, the propellant charge 96 is substantially encapsulated by a combination of the over-powder cup 90, basewad 52, and primer 86. None of the propellant is in direct contact with the tube 51 or, more particularly, its interior surface 54. Such encapsulation helps prevent sifting of the powder out of the powder chamber and between the basewad and the tube. Such encapsulation may also help to prevent moisture infiltration into the powder chamber. In firing the shotshell, when the user causes the primer to ignite and, thereby, ignite the propellant, pressure within the powder chamber 94 greatly increases. Such pressure produces a forward force on the over-powder cup 90, tending to drive the over-powder cup forward, out of the basewad 52. After an initial compression of the midsection 103 (if any), forward movement of the over-powder cup is translated to the over-shot cup 102, tending to propel the wadding and projectile(s) forward, out of the hull and down the barrel of the shotgun. The pressure increase also produces a radially outward force on the over-powder cup 90 particularly adjacent to the aft rim 150 of the over-powder cup. Such radially outward force strains the over-powder cup causing the over-powder cup to expand radially and bear against the first surface portion 138 of the basewad thereby maintaining a seal against escape of propellant combustion gases from the powder chamber 94.

Given the compliance of the basewad, such radially outward force also causes the basewad (particularly proximate the forward rim 79 thereof) to expand radially into firmer engagement with the interior surface 54 of the tube 51. This firm engagement is believed to help resist the rearward infiltration of combustion gases between the basewad and tube once the over-powder cup 90 has disengaged from the basewad.

Additionally, when the shotshell is fired, the pressure within the powder chamber 94 extends within the channel 106, pressing the hub 104 radially inward, causing the adjacent portion of the primer pocket surface 84 to bear more firmly against the primer 86 reducing the probability of combustion gas infiltration between the primer and the primer pocket surface. Unless it is desired to significantly increase the total propellant charge, the channel 106 itself need not be of significant volume and need not contain significant amount of propellant. Thus, the channel width W (FIG. 3) measured between inboard and outboard walls 152 and 153 of the channel 106 need not be great. However, the depth D between the hub rim 110 and channel bottom 108 should be sufficiently great and the hub thickness $T_H$ sufficiently small to allow the radially inward flexing of the forward portion of the hub that provides the enhanced sealing. By way of example, in an exemplary embodiment, the depth D is about 0.09 inch (0.23 cm), the width W is about 0.035 inch (0.09 cm) and the hub thickness $T_H$ is about 0.05 inch (0.13 cm). In a preferred range, the channel has a width of between 0.03 inch (0.08 cm) and 0.05 inch (0.13 cm) over the majority of a depth of at least 0.08 inch (0.20 cm).

FIG. 8 shows a mold 300 for molding the basewad of FIG. 3. The exemplary mold has a forward mold half 302 and a rear mold half or riser 304. The forward mold half 302 is formed in two pieces: an exterior cavity 306 and an interior core 308 concentrically within the cavity. The core 308 has a shape which forms the interior surface of the basewad and has a rearward projecting sleeve 310 which forms the forward facing channel 106 in the basewad. The cavity 306 has a shape which forms the exterior cylindrical surface of the basewad. The rear mold half 304 includes forward projecting fingers 312, each finger forming an associated compartment 120 in the basewad. In alternative embodiments (not shown) the sleeve 310 and channel it forms may be replaced by fully or partially discrete rearward projecting fingers and compartments. For structural integrity of the basewad, however, the fingers 312 and their associated compartments 120 should be discrete, separated from each other by webs, along a substantial portion, if not all, of their length. The rear mold half 304 and cavity 306 meet along a first parting plane 316. The rear mold half 304 and core 308 meet along a second parting plane 318 forwardly offset from the first parting plane.

In service, the plastic for forming the basewad is injected into the assembled mold 300 via one or more gates (not shown) in the rear mold half 304. Other molding techniques may alternatively be used. After the molded basewad has sufficiently cooled, the forward mold half 302 is separated from the rear mold half 304 along the first and second parting planes, the molded basewad typically remaining attached to the forward mold half due to the relatively large contact area between the two. The core may then be moved rearwardly within the cavity, causing the molded basewad to disengage from the cavity. An ejector such as a pin (not shown) may then move rearwardly within the core 308 to eject the molded basewad from the core.

The mold halves 302 and 304 are cooled by conventional cooling means (not shown) such as a circulating coolant. The presence of the sleeves 310 and fingers 312 increases the total mold surface area in contact with the molded basewad, thus, increasing heat transfer between the basewad and mold. Additionally, the location of the fingers 312 and sleeve 310 greatly decreases the typical distance between material in the basewad and the nearest portion of the mold. This reduces the self-insulating properties of the basewad. Thirdly, the total amount of material in the basewad is reduced (in the exemplary 12-gauge basewad of FIG. 3, the illustrated compartments 120 accounting for a reduction in mass of from 2.26 grams without the compartments to 2.09 grams with the compartments, a reduction of about 7.5% by weight).

These three factors: increased surface area for heat transfer; decreased distance for heat transfer; and decreased amount of material, all serve to reduce the required time to cool the basewad from a liquid state to a solid state sufficiently stable to be released from the mold and further processed without damage. An additional benefit of the presence of the compartments is a reduced decrease in diameter in the rear portion of the basewad. With a monolithic construction lacking the compartments, thermal contraction upon cooling greatly reduces the exterior diameter of the basewad along its aft portion, an even greater reduction than in the hollow forward skirt portion. The presence of the compartments reduces the degree to which the diameter contracts, although at a slight penalty to diameter consistency. The diameter adjacent the webs tends to decrease slightly more than the diameter adjacent the compartments.

Figure 5:
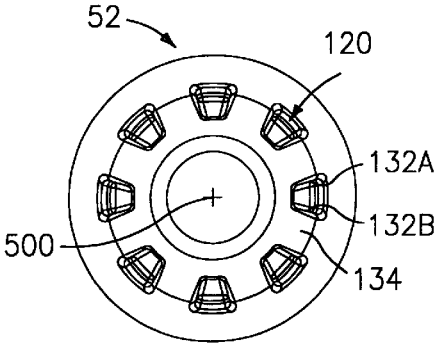
FIG. 5 is a rear view of the basewad of FIG. 3.

To efficiently achieve the benefits of the compartments 120, the exemplary embodiment provides the mold fingers 312, and thus the associated compartments 120, with certain geometries. On all sides, each finger 312 preferably has an aft-to-fore taper. For reference, the taper is measured relative to a longitudinal direction (e.g. the longitudinal axis 504 extending through the forwardmost extremity 314 of the associated finger). The taper is advantageous to provide for a longitudinal release of the basewad from the rear mold half 304 upon molding. For this purpose, the taper need not be great and may be well under 5 degrees. To this end, each finger 312 has an outboard surface 320 extending nearly the entire length of the finger (e.g. about 90% or more) at a taper angle of between about 1 and 3 degrees. This outboard surface 320 produces a correspondingly shaped outboard compartment surfaces 152 (FIG. 3). Lateral finger surfaces (not shown) are similarly tapered and produce the correspondingly shaped compartment sides 132A and 132B (FIG. 5).

An inboard surface of the finger 312 includes a proximal portion 322 extending about half the finger length at the similarly shallow angle. A distal portion 324 tapers at a higher angle (e.g. about 20 degrees or greater). This higher taper provides clearance between the compartment 120 (FIG. 3) and the channel 106, allowing the forward terminus 126 of each compartment 120 to be located forward of the channel bottom 108 while leaving enough material between the compartments 120 and channel 106 to resist rupturing due to the pressures in the powder chamber 94 when the shotshell is fired. By way of example, an advantageous range of minimum separation is from about 0.05 inch (0.13 cm) to about 0.075 inch (0.19 cm). In an exemplary embodiment, the proximal portion 322 extends along a longitudinal length of about 0.13 inch (0.33 cm) while the distal portion 324 extends along a length of about 0.11 inch (0.28 cm), the combined length of about 0.24 inch (0.61 cm) being a substantial fraction of an exemplary longitudinal length between the base surface 68 and hub rim 110 of about 0.29 inch (0.74 cm).

FIG. 9 shows an alternate basewad 175 which, except as shown and described, may be similarly constructed to basewad 52. Alternate basewad 175 is constructed to provide a relatively small powder chamber. The interior surface of the alternate basewad 175 includes a first surface portion 176 and associated bevel surface 177 formed similarly to the respective first surface portion 138 and bevel surface 78 of the basewad 52 of FIG. 3. The geometries of these surfaces are dictated or influenced by their interaction with the over-powder cup (not shown) as in the basewad 52. To provide for the reduced powder chamber volume, the interior surface of the alternate basewad 175 is provided with a convexity (as viewed in longitudinal section) aft of the first surface portion 176 and spanning a substantial portion of the radial distance between the first surface portion and the primer pocket surface. An aft surface portion 178 extends generally forward and outward from the primer pocket surface 179. The aft surface portion has a first overall cone angle with the central longitudinal axis of preferably less than 50°. An intermediate surface portion 180 extends between the aft surface portion 178 and the powder cup-engaging surface or first surface portion 176. The intermediate surface portion 180 has a second overall cone angle greater than the first overall cone angle. Thus, as the interior surface proceeds from the primer pocket surface 179 to the bevel surface 177, it has a first relatively shallow slope, transitioning to a steeper slope in a convex area then transitioning back to the extremely shallow slope of the powder cup-engaging surface in a concave area, the convex and concave areas being separated by an inflection circle 181 (an inflection point when viewed in longitudinal section). Advantageously, the inflection circle/point is at a radius which is a relatively large fraction of the radius of the cylindrical outer surface of the basewad (e.g., at least 75% thereof). The reduced volume and shallow slope along the aft surface portion 178 allow for smooth and quick ignition of a relatively small propellant charge. Whereas standard 12-gauge loads feature propellant charges of between about 17 grains and about 37 grains, the alternate basewad 175 is configured for use with an advantageous charge of from about 6 grains to about 9 grains, or even about 10 grains, of propellant. For all purposes described herein, suitable propellants are the WINCHESTER SUPER-TARGET and SUPER-FIELD lines of BALL POWDER smokeless propellant of Olin Corporation, East Alton, Ill. (BALL POWDER being a trademark used under license from Primex Technologies, Inc., St. Petersburg, Fla.).

Among a variety of further alternate basewads providing reduced powder chamber volume are constructions shown in FIGS. 10 and 11. These respectively provide powder chambers dimensioned to accommodate charges of about 5 grains to about 7 grains (FIG. 10) and about 3 grains (FIG. 11) of propellant. With a basewad 182 of FIG. 10, a longitudinal sectional profile of the interior surface is convex along a portion 183 extending smoothly from the primer pocket surface to an inflection circle/point 184. Over most of its radial extent, the portion 183 is at a shallower cone angle than is the portion 178 of the alternate basewad 175 of FIG. 9. By way of example, the cone angle of the portion 183 is about 40° or less over the first third of the radial distance/extent between the primer pocket surface and the exterior cylindrical surface of the basewad and about 55° or less over the next third. In another alternate basewad 186 of FIG. 11, an aft portion 187 of the interior surface extends nearly longitudinally (e.g. at a cone angle of less than about 10°) at a radius proximate that of the primer pocket surface and for a significant distance beyond the primer pocket surface (and potentially constituting a single smooth continuous surface with the primer pocket surface). For example, the aft surface portion 187 may so extend over distance of about 0.05 inch (0.13 cm) to about 0.3 inch (0.8 cm) ahead of the primer pocket surface. Additionally, there may be a nearly radially-extending surface portion 188 slightly aft of the powder cup-engaging surface. Such portion 188 may be at an angle within an exemplary 10° of perpendicular to the longitudinal axis and may extend over an exemplary radial extent of about 10%–50% of the span between the primer pocket surface and the exterior cylindrical surface.

It can be seen that the alternate basewads 182 and 186, when assembled in a shotshell along with a primer and wadding having an over-powder cup such as those shown in FIG. 2, have interior surfaces which are at relatively low cone angle (e.g., less than about 50°) over a majority of the longitudinal span between the forward end of the primer and the aft rim of the over-powder cup. This facilitates the reduced propellant volume described above.

A reduced-volume basewad such as the alternate basewads 175, 182 or 186 is advantageously used for propelling non-lethal projectiles. When compared with conventional projectiles (e.g. a rifled slug used in hunting) such non-lethal projectiles are often of relatively light weight (e.g. about 0.5 ounces to 1.0 ounces (14 gm to 28 gm) or less), and/or are of relatively low density (e.g., less than about 0.9 g/cm$^3$), and/or are highly compliant, and/or are discharged with a relatively low muzzle velocity, preferably no more than about 1,000 fps (305 m/s) and more preferably no more than about 550 fps (168 m/s) with a range of from 350 fps (107 m/s) to 850 fps (259 m/s) believed broadly advantageous. These velocities are achieved when the projectile is fired from a typical shotgun having a barrel length broadly in the range of 14–24 inches (36–61 cm) and, more commonly, in the more limited range of 18–22 inches (46–56 cm). At a given level of lethality (or lack thereof), higher projectile masses will be associated with lower velocities and vice versa. For example, a relatively heavy projectile of up to about 1.5 oz (43 gm) would advantageously have a low velocity in an approximate range of 250 fps (76 m/s) to 450 fps (137 m/s).

Examples of such non-lethal projectiles are elastomeric projectiles such as a solid rubber slug 190 (FIG. 12) or multiple rubber shot (not shown), a liquid filled projectile 191 (FIG. 13) having an elastomeric or other flexible casing 192 surrounding a liquid core 193, a projectile 194 (FIG. 14) having a plurality of solid particles 195 encased in an elastomeric or otherwise flexible cover or casing 196 (e.g. a "bean bag" filled with a powder, granules, pellets and the like) a projectile 200 (FIG. 15) having a sponge or other solid foam tip 201 extending forward from a relatively solid and rigid body 202, a projectile 204 (FIG. 16) having an elastomeric or other flexible casing 205 surrounding a foam core 206. Other exemplary non-lethal projectiles include wooden slugs and batons (typical density 0.3 g/cm$^3$ to 0.9 g/cm$^3$). In a 12 gauge application, such a projectile would advantageously be propelled by a propellant charge of well under 10 grains (0.65 gm), preferably less than 5 grains (0.32 gm) and preferably more than 3 grains (0.19 gm) and, most preferably, in a range of about 3.5 to about 4.5 grains (0.23–0.29 gm). With such non-lethal projectiles, the efficient and consistent propellant ignition provided by the alternate basewad 175 helps ensure consistent performance and consistent muzzle velocities which are high enough to be effective for the intended purpose of the projectile, yet low enough to be reliably non-lethal.

A variety of factors will influence scaling of the basewad of the invention for particular applications and particular shotshells. Clearly, the diameter of the exterior surface 60 will depend nearly exclusively on the shotshell gauge in view of the wall thickness of the particular tube utilized. Given an industry standard, shotshell primer (commonly identified as a 209 shotshell primer) certain dimensions of the primer pocket and features adjacent thereto, would not be subject to linear scaling (if at all) based upon basewad diameter. Additionally, several considerations relating to resisting deformation due to pressures within the powder chamber may influence scaling. By way of example, one embodiment of the basewad 52 configured for use in a 20-gauge shotshell would have an exterior surface diameter of about 0.632 inch (1.605 cm) with an overall length of about 0.71 inch (1.8 cm). Thus, such an exemplary 20-gauge basewad as well as the exemplary 12-gauge basewad would have length to diameter ratios in a range from about 1:1 to about 1.2:1. However, such a 20-gauge basewad might have nearly an identical primer pocket dimension, with a slightly reduced hub thickness (to about 0.035 inch (0.09 cm) from the 0.05 inch (0.13 cm) of the 12-gauge embodiment). Channel width and depth may largely be preserved relative to the 12-gauge embodiment.

Although one or more embodiments of the present invention have been described, it will nevertheless be understood that various modifications may be made without departing from the spirit and scope of the invention. For example, the dictates of particular end uses may influence certain parameters of the basewad as well as the remainder of the shotshell. Also, adaptations may be made relative to the type of shotshell to which the basewad of the invention is applied (e.g., gauge and shell length). Thus, the principles of the invention may be applied to shells other than those illustrated, for example, to 8-gauge shells used in industrial applications. Accordingly, other embodiments are within the scope of the following claims.

We claim:

1. An ammunition cartridge, comprising:

a tube, extending along a central longitudinal axis from an aft end to a fore end and having an interior surface and an exterior surface;

a metallic head having: a sleeve portion secured to the tube along an aft section of the tube; and a centrally apertured web portion spanning the sleeve portion and forming a base of the cartridge;

a basewad contained within the tube and separately formed therefrom, the basewad located proximate the aft end of the tube and having: a generally cylindrical exterior surface engaging the interior surface of the tube; an aft surface contacting the metallic head; and an interior surface, extending from a generally forward facing inner portion, forward and outward to a generally inward facing fore portion so as to define a skirt portion of the basewad between the exterior surface and interior surface;

at least one projectile carried within a fore volume of the tube;

a propellant charge aft of the at least one projectile; and wadding between the propellant charge and the at least one projectile, the wadding including an aft portion located at least partially concentrically within the skirt portion of the basewad so as to define a powder chamber containing the propellant charge.

2. The cartridge of claim 1 wherein said aft portion is formed by an aft-facing powder cup.

3. The cartridge of claim 2 wherein said wadding comprises the unitarily formed combination of:

said powder cup a forward facing shot cup; and a compressible midsection connecting the shot cup to the powder cup.

4. The cartridge of claim 1 wherein said at least one projectile consists essentially of a single slug.

5. The cartridge of claim 1 wherein said at least one projectile consists essentially of a plurality of shot pellets.

6. The cartridge of claim 1 wherein said basewad has an annular bevel surface coupling the fore portion of the basewad interior surface to the basewad exterior surface, said bevel surface having a first overall forward facing cone angle between the bevel surface and the central longitudinal axis greater than a second overall forward facing cone angle between the fore portion of the basewad interior surface and the central longitudinal axis.

7. The cartridge of claim 1 wherein the tube interior surface has a diameter along a substantial portion of a tube length of about 0.70 inch (1.8 cm) to about 0.80 inch (2.0 cm) and the basewad has an overall length of at least 0.80 inch (2.0 cm).

8. The cartridge of claim 1 wherein said propellant charge has a mass of 5 grains (0.32 gm) or less.

9. The cartridge of claim 1 wherein said at least one projectile is selected from the group consisting of:

elastomeric projectiles;

liquid-filled projectiles;

foam-filled projectiles;

sponge-tipped projectiles;

foam-tipped projectiles; and projectiles having a plurality of solid particles encased in a flexible cover.

10. The cartridge of claim 1 wherein the basewad has a plurality of blind compartments open to the basewad aft surface extending forward therefrom.

11. The cartridge of claim 10 wherein:

there are six to ten such compartments;

the aft surface includes:

a central portion surrounding a primer pocket opening; and an outer portion extending radially outward from the central portion and forwardly offset therefrom; and the plurality of compartments are located along a boundary between the central portion and the outer portion.

12. The cartridge of claim 1 wherein:

the propellant charge is sized so that when the cartridge is chambered in a weapon having a barrel length in the range of 14–24 inches (36–61 cm) and the primer is caused to ignite the propellant charge, the projectile is expelled from the weapon wit a muzzle velocity of no more than about 1,000 ft/sec (305 m/s).

13. The cartridge of claim 12 wherein the propellant charge is sized so that when the cartridge is chambered in such a weapon having a barrel length in the range of 18–22 inches (46–56 cm) and the primer is caused to ignite the propellant charge, the projectile is expelled from the weapon with a muzzle velocity of no more than about 550 fps (168 m/s).

14. The cartridge of claim 12 wherein said at least one projectile is a single projectile having a mass of about 1 oz (28 gm) or less.

15. The cartridge of claim 12 wherein said at least one projectile is selected from the group consisting of:

elastomeric projectiles;

liquid-filled projectiles;

foam-filled projectiles;

sponge-tipped projectiles;

foam-tipped projectiles; and projectiles having a plurality of solid particles encased in a flexible cover.

16. The cartridge of claim 12 wherein said propellant charge has a mass of less than 5 grains (0.32 gm).

17. The cartridge of claim 12 wherein a longitudinal sectional profile of said interior surface of the basewad is substantially convex along a portion including a majority of a longitudinal span of the basewad between the primer and an aft extremity of the wadding.

18. The cartridge of claim 1 wherein the basewad interior surface includes an annular, generally forward-facing channel surrounding hub, the channel having a depth below a forward rim of the hub and a median width less than half said depth.

19. The cartridge of claim 18 wherein said dept is at least 0.06 inch (0.15 cm) and said median width is less than 0.05 inch (0.13 cm).

20. A unitary plastic basewad for use with a tube of a shell casing, said basewad having:

an aft-facing, centrally-apertured, base surface;

an internal primer pocket surface extending forward from the central aperture of the base surface;

an exterior surface extending forward of the base surface to a mouth;

an interior surface, extending from a generally forward facing inner portion, forward and outward to a generally inward facing over-powder wad-engaging surface for encircling and slideably engaging a powder cup of an over-powder wad so to define a skirt portion of the basewad between the exterior surface and the interior surface; and an annular bevel surface coupling the over-powder wad-engaging surface to the basewad exterior surface, said bevel surface having a first overall forward facing cone angle between the bevel surface and a central longitudinal axis between 20 and 45 degrees and said over-powder wad-engaging surface having a second overall forward facing cone angle of less than the first cone angle and wherein the first overall forward facing cone angle is effective to allow the bevel surface to guide insertion of the powder cup into telescopic engagement with the over-powder wad-engaging surface and wherein the skirt portion has a thickness effective to permit the over-powder wad-engaging surface to continuously contact the powder cup.

21. The basewad of claim 20 further having an internal, generally fore-to-aft tapering surface coupling the over-powder wad-engaging surface to a hub portion of the basewad.

22. The basewad of claim 21 wherein the tapering surface includes an annular, generally forward-facing channel surrounding the hub, the channel having a depth below a forward rim of the hub and a median width less than half said depth.

23. The basewad of claim 22 wherein said depth is at least 0.06 inch (0.15 cm) and said median width is less than 0.05 inch (0.13 cm).

24. The basewad of claim 22 wherein a plurality of blind compartments open to the base surface extend forward therefrom and have forward extremities located forward of a bottom of said channel.

25. The basewad of claim 20 wherein the over-powder wad-engaging surface has, over a majority of its length, a for to-aft taper of less than 2°.

26. The plastic basewad of claim 20 consisting essentially of polyethylene and further having:

a second bevel surface extending forward and radially inward from the base surface so as to connect the base surface and exterior surface; and an overall length selected so that a ratio of the overall length to the diameter of the exterior surface is from about 1:1 to about 1.2:1.

* * * * *